United States Patent [19]

Polizzotti

[11] Patent Number: 5,077,021

[45] **Date of Patent: * Dec. 31, 1991**

[54] AGGLOMERATING AGENTS FOR CLAY CONTAINING ORES

[75] Inventor: David M. Polizzotti, Yardley, Pa.

[73] Assignee: Betz Laboratories, Inc., Trevose, Pa.

[ * ] Notice: The portion of the term of this patent subsequent to Dec. 31, 2008 has been disclaimed.

[21] Appl. No.: 683,117

[22] Filed: Apr. 8, 1991

Related U.S. Application Data

[60] Continuation of Ser. No. 475,630, Feb. 6, 1990, abandoned, which is a division of Ser. No. 325,608, Mar. 20, 1989, abandoned.

[51] Int. Cl.[5] ..... C01G 7/00; C22B 11/00

[52] U.S. Cl. ..... 423/27; 423/29; 75/744; 75/770; 75/772; 75/747

[58] Field of Search ..... 75/744, 770, 772, 747; 423/27, 29

[56] References Cited

U.S. PATENT DOCUMENTS

| | | | |
|---|---|---|---|
| 3,418,237 | 12/1968 | Booth et al. | 75/3 |
| 3,660,073 | 5/1972 | Youngs et al. | 75/3 |
| 3,823,009 | 7/1974 | Lailach | 75/3 |
| 3,860,414 | 1/1975 | Lang et al. | 75/3 |
| 3,893,847 | 7/1975 | Derrick | 75/3 |
| 3,898,076 | 8/1975 | Ranke | 75/3 |
| 4,256,705 | 3/1981 | Heinen et al. | 423/27 |
| 4,256,706 | 3/1981 | Heinen et al. | 423/29 |
| 4,362,559 | 12/1982 | Perez et al. | 75/3 |
| 4,802,914 | 2/1989 | Rosen et al. | 75/3 |
| 4,875,935 | 10/1989 | Gross et al. | 75/117 |
| 4,898,611 | 2/1990 | Gross | 75/3 |

*Primary Examiner*—Gary P. Straub
*Assistant Examiner*—Steven Bos
*Attorney, Agent, or Firm*—Alexander D. Ricci; Steven D. Boyd

[57] ABSTRACT

Agglomerating agent and method for use in heap leaching of mineral bearing ores. A moderate to high molecular weight anionic polymer either alone or in combination with cement provides a highly effective agglomerating agent. The anionic polymer is preferably a copolymer of acrylamide and acrylic acid. The polymer preferably has a molecular weight of from about 1 to 8 million or higher.

6 Claims, 3 Drawing Sheets

THE EFFECT OF ACRYLAMIDE/ACRYLIC ACID COPOLYMERS ON THE PERCOLATION RATE OF AGGLOMERATED CLAYEY GOLD ORE "A"

AM/AA = ACRYLAMIDE/ACRYLIC ACID MOLE PERCENTS
M.W. = MOLECULAR WEIGHT
H(>8 MILLION). M(1-8 MILLION). L(< 1 MILLION)

THE EFFECT OF ANIONIC POLYMERS ON THE PERCOLATION RATE OF AGGLOMERATED CLAYEY GOLD ORE "B"

EFFECT OF ANIONIC POLYMERS ON THE PERCOLATION RATE OF CEMENT STABILIZED ORE "B"

AGGLOMERATING AGENTS FOR CLAY CONTAINING ORES

This is a continuation of copending application Ser. No. 07/475,630 filed on Feb. 6, 1990, now abandoned, which in turn is a divisional of application Ser. No. 07/325,608 filed Mar. 20, 1989, now abandoned.

FIELD OF THE INVENTION

The present invention relates to agglomerating agents applied to clay containing ores to be subjected to chemical leaching. The agents of the present invention aid in agglomeration of ores containing an excess of clays and/or fines to allow effective heap leaching for mineral recovery.

BACKGROUND OF THE INVENTION

In recent years, the use of chemical leaching to recover minerals from low grade ores has grown. For example, caustic cyanide leaching is used to recover gold from low grade ores having about 0.02 ounces of gold per ton. Such leaching operations are typically carried out in large heaps. The mineral bearing ore from an open pit mine is crushed to produce an aggregate that is coarse enough to be permeable in a heap but fine enough to expose the precious metal values in the ore to the leaching solution. After crushing, the ore is formed into heaps on impervious leach pads. A leaching solution is evenly distributed over the top of the heaps by sprinklers, wobblers, or other similar equipment at a rate of from about 0.003 to 0.005 gallons per minute per square foot. As the barren leaching solution percolates through the heap, it dissolves the gold contained in the ore. The liquor collected by the impervious leach pad at the bottom of the heap is recovered and this "pregnant solution" is subjected to a gold recovery operation. The leachate from the gold recovery operation is held in a barren pond for reuse.

Economical operation of such heap leaching operations requires that the heaps of crushed ore have good permeability after being crushed and stacked so as to provide good contact between the ore and the leachate. Ores containing excessive quantities of clay and/or fines (i.e., 30% by weight of −100 mesh fines) have been found undesirable due to their tendency to slow the percolation flow of the leach solution. Slowing of the percolating flow of leach solution can occur when clay fines concentrate in the center of the heap while the large rock fragments tend to settle on the lower slopes and base of the heap. This segregation is aggravated when the heap is leveled off for the installation of the sprinkler system that delivers the leach solution. This segregation results in localized areas or zones within the heap with marked differences in permeability. The result is channeling where leach solution follows the course of least resistance, percolating downward through the coarse ore regions and bypassing or barely wetting areas that contain large amounts of fines. Such channeling produces dormant or unleached areas within the heap. The formation of a "slime mud" by such fines can be so severe as to seal the heap causing the leach solution to run off the sides rather than to penetrate. This can require mechanical reforming of the heap. The cost in reforming the heaps which can cover 160 acres and be 200 feet high negates the economics of scale that make such mining commercially viable.

In the mid-1970's, the United States Bureau of Mines determined that ore bodies containing high percentages of clay and/or fines could be heap leached if the fines in the ore were agglomerated. The Bureau of Mines developed an agglomeration process in which crushed ore is mixed with Portland Cement at the rate of from 10 to 20 pounds per ton, wetted with 16 to 18% moisture (as water or caustic cyanide), agglomerated by a disk pelletizer and cured for a minimum of 8 hours before being subjected to stacking in heaps for the leaching operation. When processed in this manner, the agglomerated ore was found to have sufficient green strength to withstand the effects of degradation caused by the heap building and leaching operations.

In commercial practice, the method developed by the United States Bureau of Mines has not met with widespread acceptance because of the cost and time required. However, the use of cement, as well as lime, as agglomerating agents is known. Agglomerating practices tend to be site specific and non-uniform. Typically, the action of the conveyor which moves the ore from the crusher to the ore heaps or the tumbling of ore down the conical pile is relied on to provide agglomeration for a moistened cement-ore mixture. Lime has been found to be less effective than cement in controlling clay fines. It is believed this is because the lime must first attack the clay lattice structure in order to provide binding.

Cement has been found to be most effective in high siliceous ores (crushed rock) and noticeably less effective in ores having a high clay content. With the growth of such mining methods, the need for cost effective, efficient agglomerating materials has grown.

It is an object of the present invention to provide an agglomerating agent for use in the heap leaching of mineral bearing ores which improves the permeability of the heap.

It is a further object of the present invention to provide an agglomerating agent for use in heap leaching of mineral bearing ores which eliminates or reduces ponding and channeling of the leach solution.

It is an additional object of the present invention to provide an agglomerating agent for use in heap leaching of mineral bearing ores which improves ore extraction from material having a size of less than about 50 microns.

It is an additional object of the present invention to provide an agglomerating agent which allows finer crushing of the mineral bearing ore without a deleterious influence on percolation rate of leach solution through ore heaps.

SUMMARY OF THE INVENTION

The present invention is directed toward new and improved agglomerating agents for use in heap leaching of ores. More specifically, the present invention is directed toward a new agglomerating agent comprising a moderate to high molecular weight synthetic polymer. Preferably, the agglomerating agent of the present invention is an anionic copolymer of an acrylamide and an acrylic acid. It was discovered that such polymers either alone, or in combination with reduced quantities of cement provide highly effective agglomerating agents. The effectiveness of the agglomerating agents of the present invention was determined in standardized water stability testing.

Water stability measurements where made which reflect an agglomerating agent's ability to interact with the arrangement of clay/soil particles and pore geometry within the aggregate as these factors determine an agglomerate's mechanical strength, permeability and erodability characteristics. The standardized testing employed is based upon the fact that poorly stabilized agglomerates swell, fracture and disintegrate upon contact with water to release a large number of fines. The "slime mud" that forms as a consequence of agglomerate degradation retards the percolation rate (i.e. drain rate) of the column of agglomerate. The standardized testing was engineered so as to control agglomerate formation, moisture content, fines/solid ratio, surface area, particulate size, etc. in order to allow comparison of the results of the different runs.

The preferred copolymer of the present invention, a 70/30 mole percent acrylamide/acrylic acid copolymer, was more effective at an application rate of 1 pound per ton than prior art cement at 10 pounds per ton. The selection of the properties of an agglomerating agent (i.e. the molecular weight, mole ratio of copolymer and application rate) is a function of the actual ore to be treated. In practice, bench scale testing will allow selection of the most effective polymer for a specific ore.

DETAILED DESCRIPTION OF THE PREFERRED EMBODIMENT

The present invention provides a new agglomerating agent for use in heap leaching of ores. It has been discovered that a moderate or high molecular weight polymer such as an acrylamide/acrylic acid provides effective agglomerating action in mining operations. The polymers of the present invention may be employed singly or in combination with cement or other agglomerating agents. When employed singly, the polymers of the present invention were found to provide effective agglomeration of ores containing excessive quantities of clays and/or fines. The polymer agglomerating agents of the present invention were also found to be effective when employed in combination with cement.

To allow comparison of the efficiency of the agglomerating agents of the present invention when applied to different ores, a standardized testing procedure was developed. This procedure allows the efficiency of the various agglomerating agents to be compared. The procedure measures the percolation rate of a predetermined volume of a leachate solution through a column of agglomerated ore. The procedure uses water stability to measure the strength of the agglomerated ores. The procedures take into account the fact that poorly stabilized agglomerates swell, fracture and disintegrate upon contact with water to release a large number of fines. The slime mud which forms as a consequence of agglomerate degradation retards the percolation rate of the leach solution through the agglomerated ore. The test procedure is designated to take into account effects such as variable surface area that are associated with raw crushed ore.

The preferred agglomeration agent of the present invention is an anionic copolymer of acrylamide and acrylic acid. It is believed that comparable or better performance would be achieved if the copolymer solution were applied as a foam wherein copolymer distribution would be improved. It was discovered that with the preferred anionic copolymer agglomerating agent, efficiency was somewhat influenced by the composition of the ore to be treated.

Figure 1:
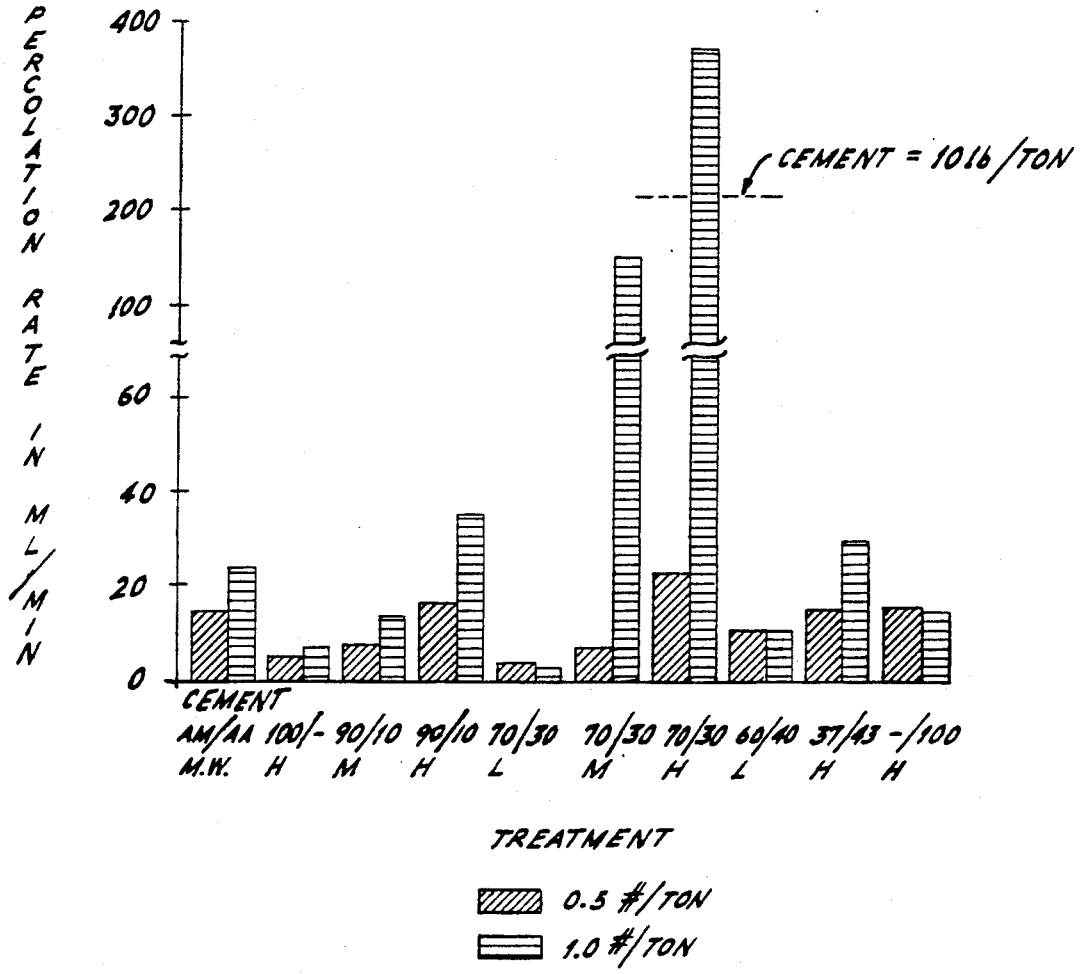
FIGS. 1, 2 and 3 are graphs showing the percolation rate in millilters per minute for various ores and treatments as described below.
Figure 2:
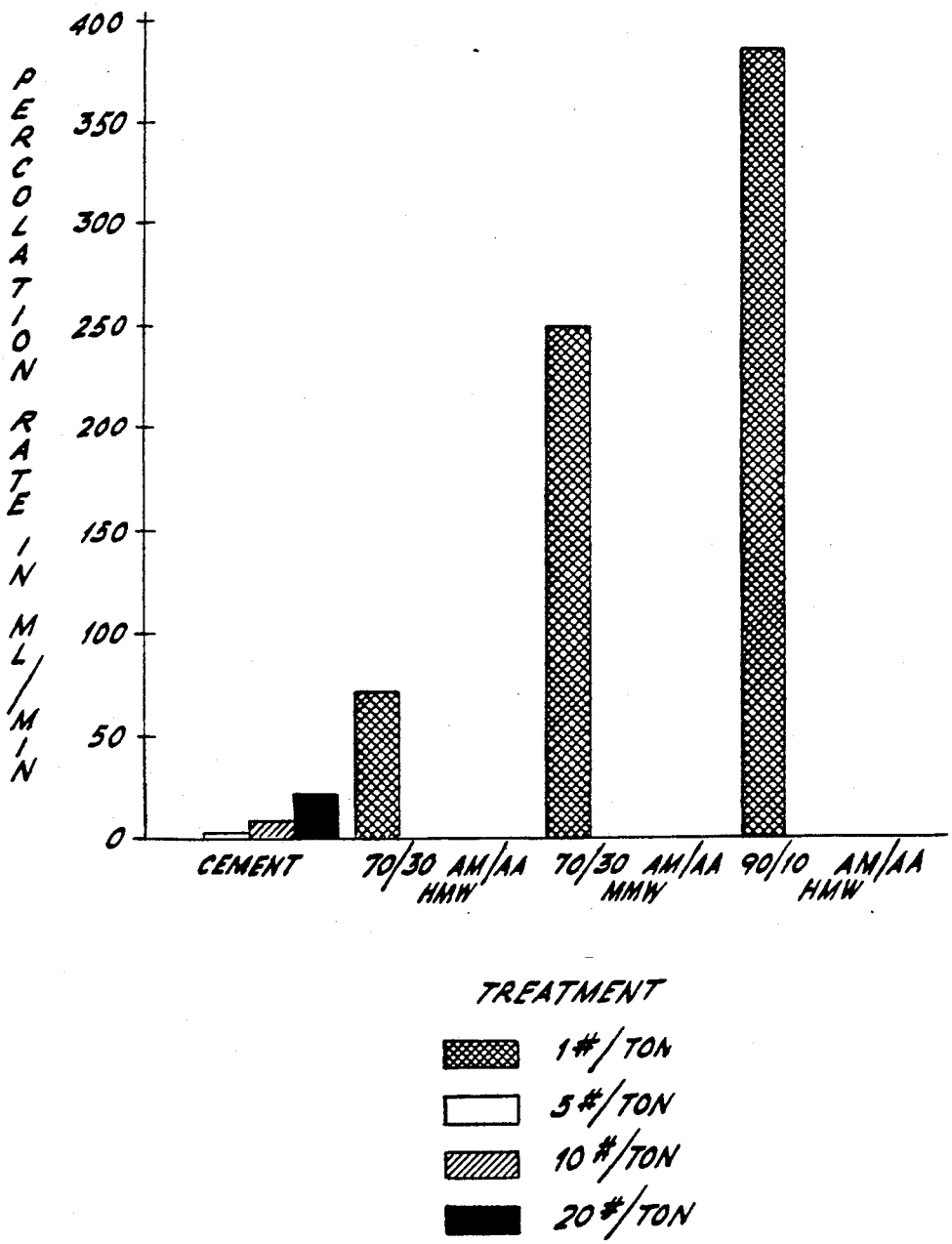

A comparison of FIGS. 1 and 2 shows that the selection of the most efficient copolymer will be, in part, dependent upon the ore to be treated. FIG. 1 summarizes data relative to the agglomeration effect of prior art cement and acrylamide/acrylic acid copolymers of varying monomer ratio and molecular weights. The data summarized in FIG. 1 relates to a clay containing ore, designated ore A. FIG. 2 summarizes data collected in the testing of prior art cement and acrylamide/acrylic acid copolymers of varying monomer ratio and molecular weight for another clay containing gold ore, designated ore B.

As can be seen from FIG. 1, for the ore A, the most effective agglomerating agent, as evidenced by the high percolation rate, is an anionic, high molecular weight, 70/30 acrylamide/acrylic acid copolymer. As shown in Table 1, these agglomerating agents are particularly effective when used in combination with cement.

TABLE 1

Effect of Anionic Acrylamide/Acrylic Acid Copolymers on The Percolation Rate of Cement Stabilized Ore "A" Agglomerates. In These Tests, Ore "A" Agglomerates Were Stabilized With Cement At 5 Pounds/Ton.

| Treatment | Application Rate (pounds/Ton) | Percolation Rate (ML/Min) | Molecular Weight |
|---|---|---|---|
| Cement | 5 | 119 | — |
| Cement | 10 | 217 | — |
| Cement | 20 | 500 | — |
| 70/30 AM/AA* | 1.0 | 455 | $12\text{-}16 \times 10^6$ |
| 70/30 AM/AA | 1.0 | 455 | $2\text{-}4 \times 10^6$ |
| 90/10 AM/AA | 1.0 | 500 | $12\text{-}16 \times 10^6$ |

*70/30 AM/AM refers to a 70/30 mole ratio copolymer of acrylamide (AM) and acrylic acid. 90/10 AM/AA is a 90/10 mole ratio of acrylamide to acrylic acid.

From FIG. 2, or ore B, it can be seen that the most effective agglomerating agent was an anionic, high molecular weight, 90/10 acrylamide/acrylic acid copolymer. As can be seen from the figures, the efficiency of the agglomerating agent in the present invention can be maximized by varying the ratio of monomers in the copolymer, the molecular weight of the copolymer and the treatment rate.

The fact that the copolymer used for ore A did not provide optimum percolation rates for ore B underscores the fact that the copolymer mole ratio and molecular weight selected for a given application will to a large extent depend on the nature of the ore body.

Figure 3:
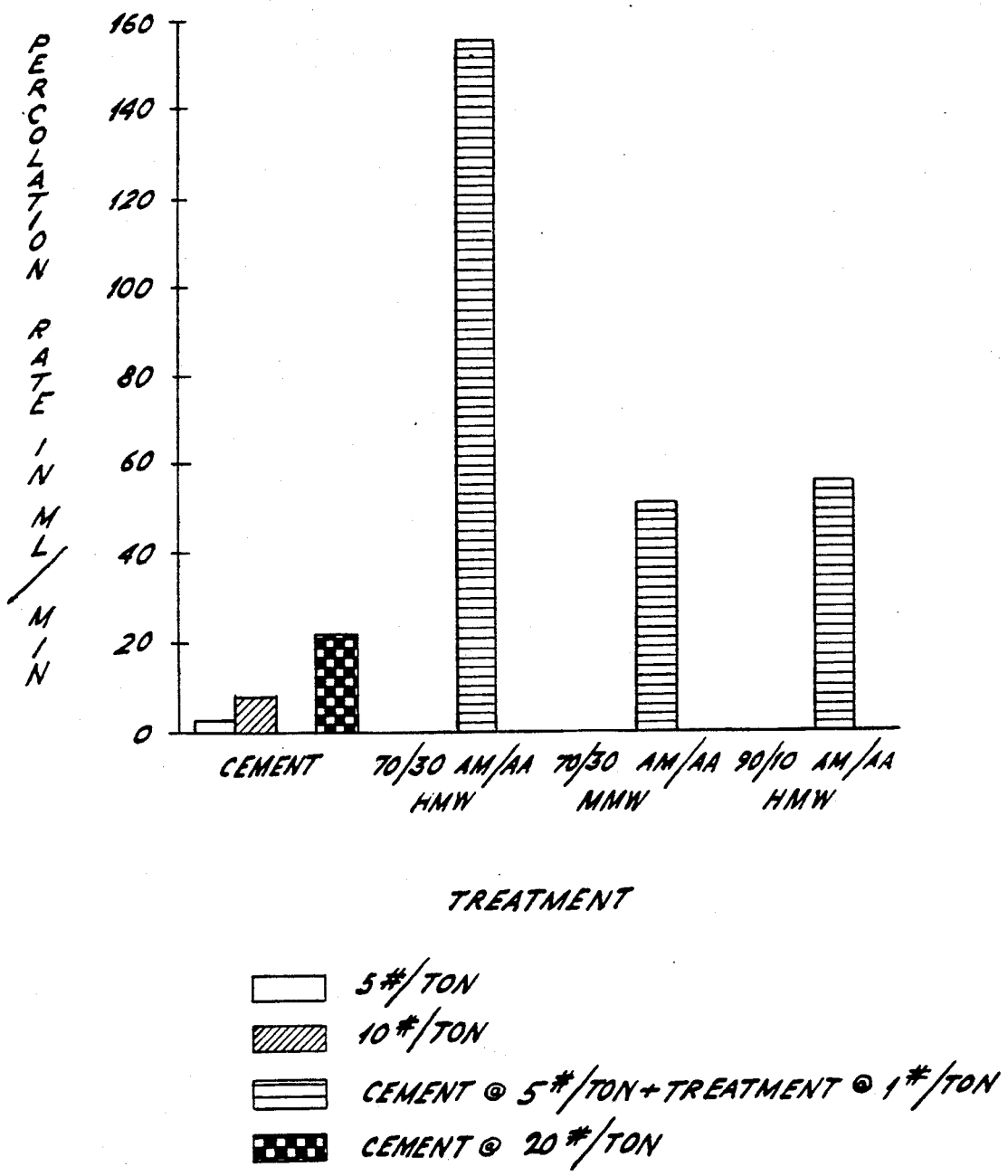

FIG. 3 summarize the data relative to the effectiveness of the agglomerating agents of the present invention on ore B when used in combination with cement.

The results summarized in Tables 2 and 3 further illustrate the effectiveness of the medium and high molecular weight 70/30 and 90/10 mole percent acrylamide/acrylic acid copolymers relative to cement as agglomerating agents.

As shown in Table 2, Portland Cement was of little value in enhancing the percolation rate of ore C, a high clay content ore. In the case of ore C, cement at 20 #/ton appeared to have a negative impact on percolation rate. For ore C, lime was not an effective agglomerating agent.

When ore C was treated with the acrylamide/ acrylic acid copolymers of the prevent invention, significant improvements in the percolation rate values were realized. As shown, the percolation rate of ore C increased from 134 ml/min when treated with cement at 10 #/ton to 417 ml/min when treated with a high molecular weight 70/30 mole percent acrylamide/acrylic acid copolymer at 0.5 #/ton. As shown in Table 3, these polymers may be used in combination with cement.

TABLE 2

Effect of Anionic Acrylamide/Acrylic Acid Copolymers on The Percolation Rate of Ore Sample C

| Treatment | Application Rate (pounds/Ton) | Average Percolation Rate (ML/Min) | Molecular Weight |
|---|---|---|---|
| Control | — | 24 | — |
| Cement | 5 | 30 | — |
| Cement | 10 | 134 | — |
| Cement | 20 | 34 | — |
| Lime | 5 | 6 | — |
| Lime | 10 | 3 | — |
| Lime | 20 | 3 | — |
| 70/30 AM/AA* | 0.5 | 417 | $12\text{-}16 \times 10^6$ |
| | 1.0 | 332 | $12\text{-}16 \times 10^6$ |
| | 2.0 | 401 | $12\text{-}16 \times 10^6$ |
| 70/30 AM/AA* | 0.5 | 333 | $2\text{-}4 \times 10^6$ |
| | 1.0 | 361 | $2\text{-}4 \times 10^6$ |
| | 2.0 | 356 | $2\text{-}4 \times 10^6$ |
| 90/10 AM/AA* | 0.5 | 385 | $12\text{-}16 \times 10^6$ |
| | 1.0 | 361 | $12\text{-}16 \times 10^6$ |
| | 2.0 | 359 | $12\text{-}16 \times 10^6$ |

*70/30 AM/AA is a 70/30 mole percent acrylamide (AM)/Acrylic Acid (AA) copolymer. 90/10 AM/AA is a 90/10 mole percent acrylamide/acrylic acid copolymer.

TABLE 3

Effect of Anionic Acrylamide/Acrylic Acid Copolymers on The Percolation Rate of Cement Stabilized Ore "C" Agglomerates. In These Tests Ore "C" Agglomerates Were Stabilized With Cement at 5 Pounds/Ton

| Treatment | Application Rate (pounds/Ton) | Percolation Rate (ML/Min) | Molecular Weight |
|---|---|---|---|
| 90/10 AM/AA | 1.0 | Test 1 96 | $12\text{-}16 \times 10^6$ |
| | | 2 200 | |
| | | 3 119 | |
| | 2.0 | Test 1 333 | |
| | | 2 179 | |
| 70/30 AM/AA | 1.0 | Test 1 278 | $12\text{-}16 \times 10^6$ |
| | | 2 250 | |
| | | 3 385 | |
| | 2.0 | Test 1 385 | |
| | | 2 333 | |
| 70/30 AM/AA | 1.0 | Test 1 333 | $2\text{-}4 \times 10^6$ |
| | | 2 278 | |
| | | 3 333 | |
| | 2.0 | Test 1 294 | |
| | | 2 417 | |

The anionic medium (i.e., about 2 million) and high (i.e., 12-16 million) molecular weight 70/30 and 90/10 mole percent acrylamide/acrylic acid copolymers reported above are only illustrative of the type of polymer systems necessary for optimum effectiveness. In practice it is believed that 90/10 to 60/40 mole ratio acrylamide/acrylic acid copolymers with molecular weights between 1 and 16 million would be effective. Of course, derivatives of these copolymers could also be effective.

The preferred agglomerating agent of the present invention is a copolymer of acrylamide and acrylic acid. The mole ratio of acrylamide to acrylic acid can vary from about 90 to 10 to about 60 to 40. The preferred copolymer has a moderate to high molecular weight, that is from about one million up to above 8 million. The copolymer is preferably anionic, although it is believed that the presence of some cationic segments in the copolymer would not adversely affect the agglomeration action.

The most preferred agglomerating agent of the present invention is an anionic copolymer of acrylamide and acrylic acid with a monomer ratio of about 70 to 30 mole percent and having a molecular weight of above 8 million.

Typical treatment rates for the anionic/moderate to high molecular weight copolymer of the present invention range from about 0.125 up to about 2.0 pounds per ton of ore. When used in combination with cement, typical treatment rates are about 1 pound polymer and 5 pounds of cement per ton of ore. Typical prior art treatment rates for cement are from 10 to 20 pounds per ton. Thus, the copolymer of the present invention provides for effective agglomeration at greatly reduced treatment rates.

While the present invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A process for percolation leaching of gold values from a gold bearing ore containing clays or fines comprising:

(a) admixing the gold bearing ore with an anionic copolymer of acrylamide and acrylic acid wherein the mole ratio of acrylamide to acrylic acid ranges from about 90 to 10 to about 70 to 30, said copolymer having a molecular weight above about 1 million, at a treatment rate sufficient to provide an agglomerate having a percolation rate, higher than that obtained when cement is used as the agglomerating agent at the same treatment rate;

(b) mechanically manipulating the admixture to effect agglomeration;

(c) treating the agglomerated admixture with a leaching solution to leach gold values from said gold bearing ore.

2. The process of claim 1 wherein the molecular weight of said polymer is from about 1 million to about 16 million.

3. The process of claim 1 wherein the mole ratio of acrylamide to acrylic acid is about 70 to 30.

4. A process for percolation leaching of gold values from a gold bearing ore containing clays or fines comprising:

(a) admixing the gold bearing ore with an agglomerating agent consisting essentially of an anionic copolymer of acrylamide and acrylic acid wherein the mole ratio of acrylamide to acrylic acid ranges from about 90 to 10 to 70 to 30, said copolymer having a molecular weight above about 1 million, at a treatment rate sufficient to provide an agglomerate having a percolation rate, higher than that obtained when cement is used as the agglomerating agent at the same treatment rate;

(b) mechanically manipulating the admixture to effect agglomeration; and (c) treating the agglomerated admixture with a leaching solution to leach gold values from said gold bearing ore.

5. The process of claim 4 wherein the molecular weight of said polymer is from about 1 million to about 16 million.

6. The process of claim 4 wherein the mole ratio of acrylamide to acrylic acid is about 70 to 30.

* * * * *